US008183797B2

(12) United States Patent
McKinney

(10) Patent No.: US 8,183,797 B2
(45) Date of Patent: May 22, 2012

(54) 90-260VAC DIMMABLE MR16 LED LAMP

(75) Inventor: Steven McKinney, Piney Flats, TN (US)

(73) Assignee: Boca Flasher, Inc, Boca Raton, FL (US)

( * ) Notice: Subject to any disclaimer, the term of this patent is extended or adjusted under 35 U.S.C. 154(b) by 270 days.

(21) Appl. No.: 12/585,589

(22) Filed: Sep. 18, 2009

(65) Prior Publication Data

US 2011/0068703 A1 Mar. 24, 2011

(51) Int. Cl.
*G05F 1/00* (2006.01)

(52) U.S. Cl. ..... 315/308; 315/307; 315/291; 315/247; 315/56; 362/227; 362/249.02; 362/555

(58) Field of Classification Search ..... 315/185 R, 315/51, 210, 291, 246, 56, 247, 307, 30, 315/312; 362/257, 236, 240, 249, 252, 800, 362/227, 249.02, 555
See application file for complete search history.

(56) References Cited

U.S. PATENT DOCUMENTS

| | | | | |
|---|---|---|---|---|
| 6,853,151 | B2 * | 2/2005 | Leong et al. | 315/185 R |
| 7,088,059 | B2 | 8/2006 | McKinney et al. | |
| 7,358,679 | B2 * | 4/2008 | Lys et al. | 315/51 |
| 2007/0222399 | A1 * | 9/2007 | Bondy et al. | 315/291 |
| 2009/0261748 | A1 * | 10/2009 | McKinney et al. | 315/254 |
| 2011/0068704 | A1 * | 3/2011 | McKinney | 315/210 |

OTHER PUBLICATIONS

National Semiconductor, Application Note 556, National.com, Sep. 2002.
Super Nade, "Understanding Buck Regulators", Overclockers.com, Nov. 25, 2006.
Supertex, Inc., "HV9931 Unity Power Factor LED Lamp Driver Data Sheet", HV9931, 1235 Bordeaux Drive, Sunnyvale, CA 94089, Supertex.com, 2008.
Supertex, Inc., "HV9931DB5 Universal Input, Single High Brightness, LED Driver", HV9931DB5, 1235 Bordeaux Drive, Sunnyvale, CA 94089, Supertex.com, 2006.
Supertex, Inc., "HV9931 Unity Power Factor LED Lamp Driver", Application Note AN-H52, 1235 Bordeaux Drive, Sunnyvale, CA 94089, Supertex.com, 2009.

* cited by examiner

*Primary Examiner* — Haiss Philogene
(74) *Attorney, Agent, or Firm* — John J. Yim

(57) ABSTRACT

A line voltage LED Lamp produces variable illumination in response to industry standard lighting dimmers, through the use of an input voltage monitoring circuit which variably controls the current output of an integral driver in response to sensed changes in the input voltage. A cascaded converter circuit is used to achieve a very high step-down ratio, enabling the LEDs to be driven from a high input voltage without the need for a power transformer. Electrolytic capacitors are avoided, increasing the life of the driver circuit in the high ambient temperatures typically encountered in the base of similar lamps. The circuit employed drives high power LEDs, and the lamp is adapted to fit common MR16 size fixtures. Illumination output equivalent to similar size halogen bulbs is achieved.

14 Claims, 12 Drawing Sheets

Buckboost-Buck LED Driver Implemented With The HV9931 PWM Controller

Dimming Control Circuit For Buckboost-Buck LED Driver

Fig. 1 Typical LED Luminous Intensity vs. Forward Current
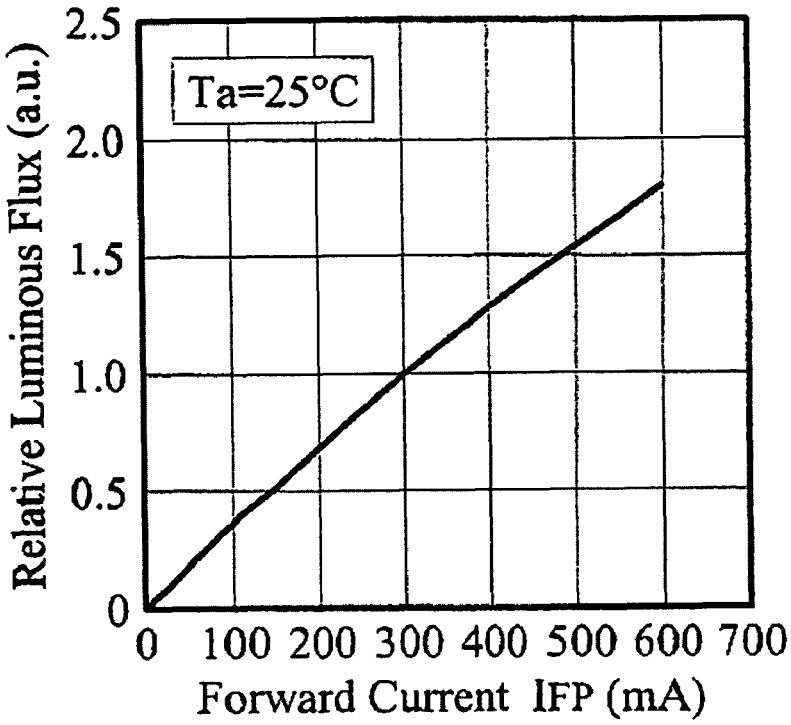

Fig. 2 Linear Regulator Driving LED Load
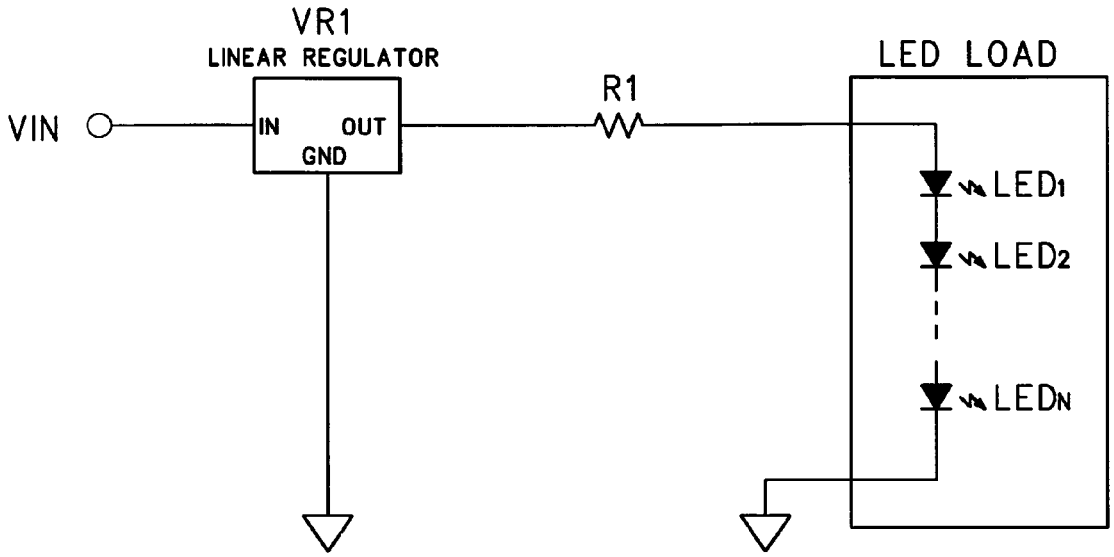

Fig. 3 Luminous Intensity vs. Input Voltage In A Linear Regulated LED Driving Circuit
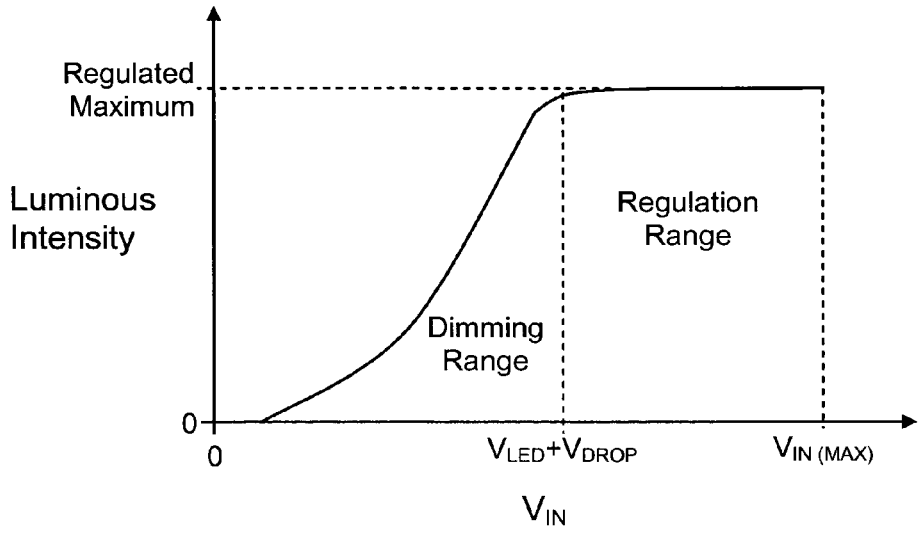

Fig. 4 Non-Linear Dimming Response In A Linear Regulated LED Driving Circuit
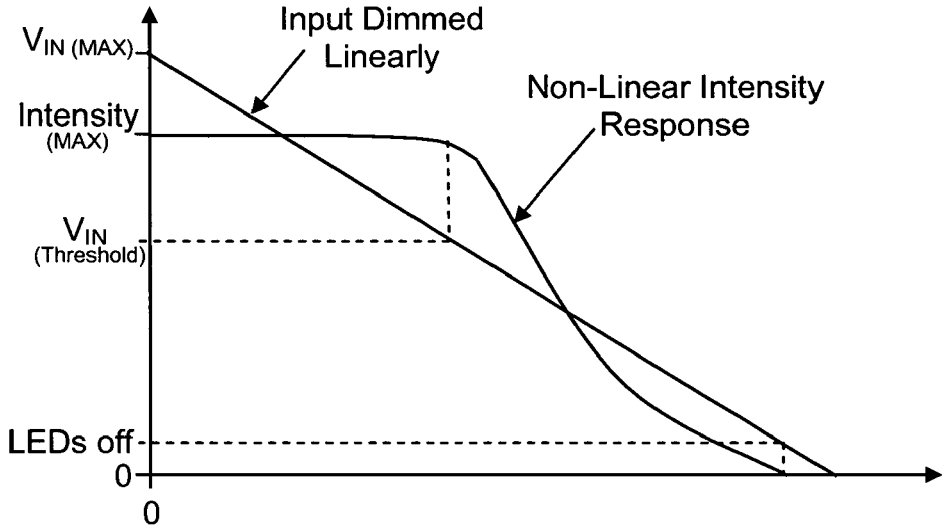

Fig. 5 Transformerless Power Converter
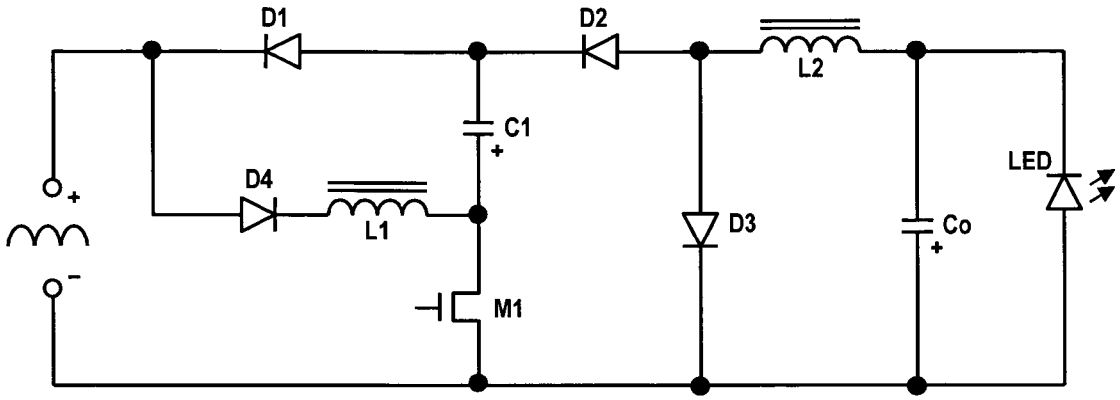

Fig. 6 Power Converter Switching State (a) Energizing L1 and L2
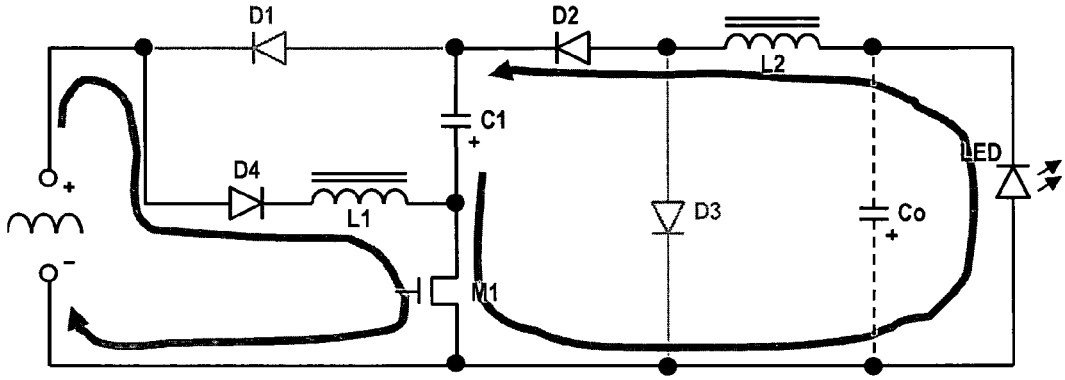

Fig. 7 Power Converter Switching State (b) De-energizing L1 and L2
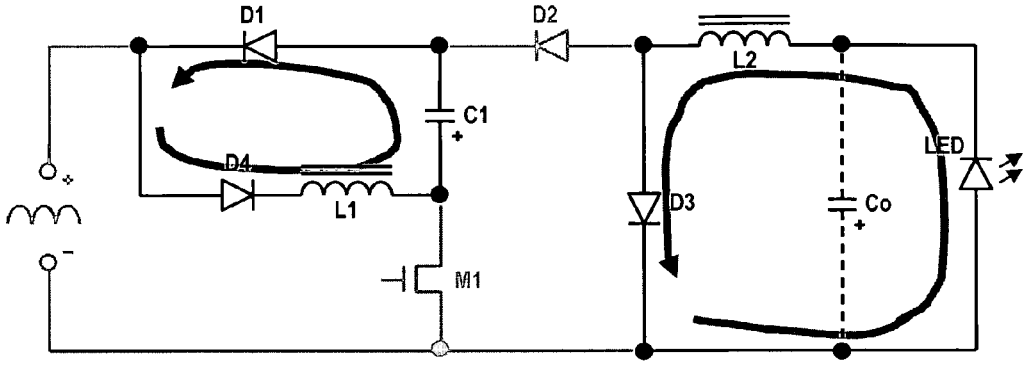

Fig. 8 Power Converter Switching State (c) Dead Time of L1
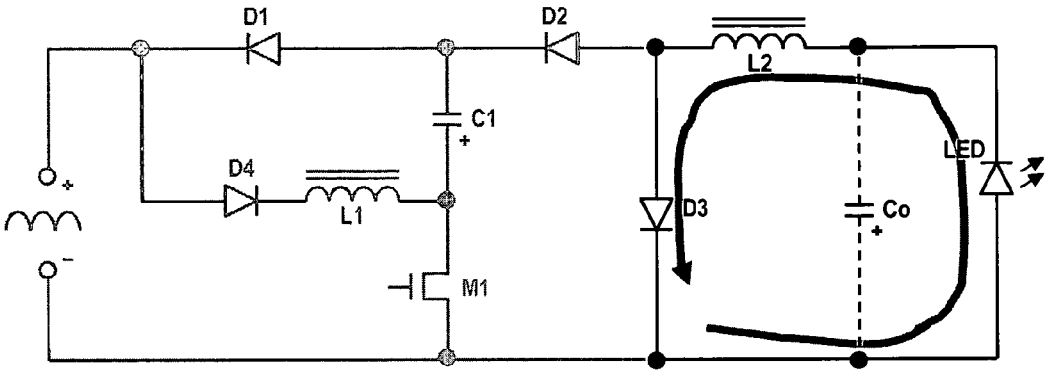

Fig. 9 Power Converter Input Current/Voltage Waveforms
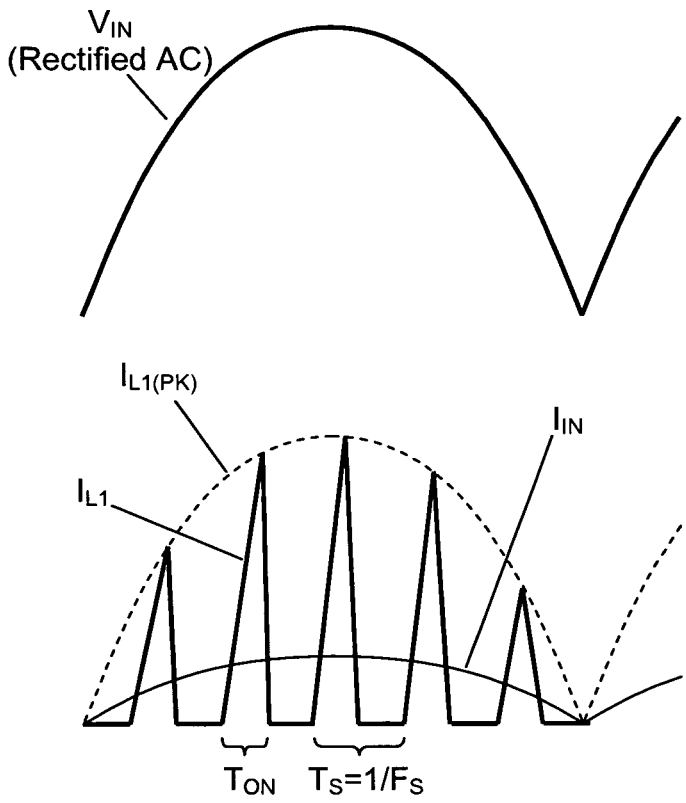

Fig. 10 Buckboost-Buck LED Driver Implemented With The HV9931 PWM Controller
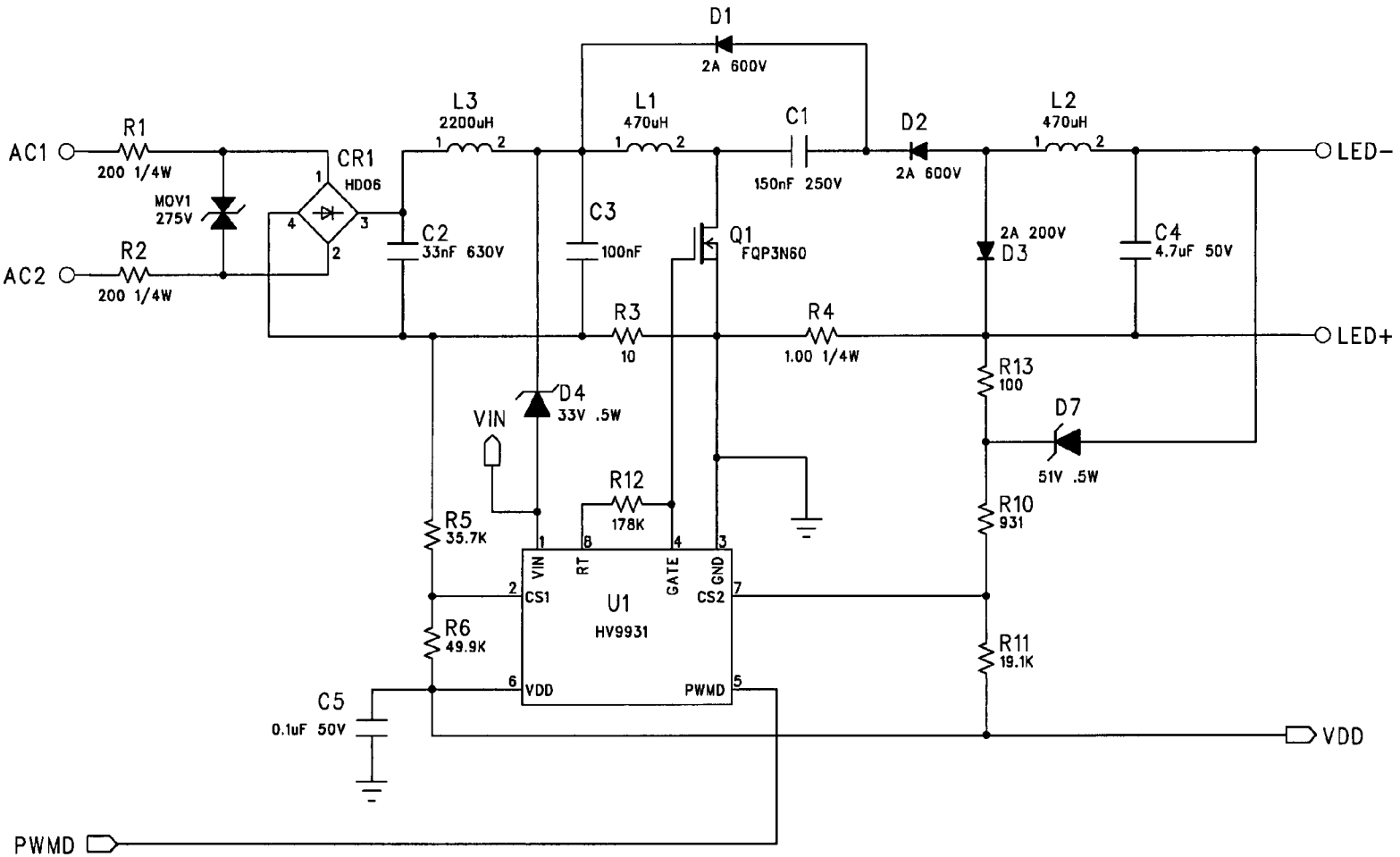

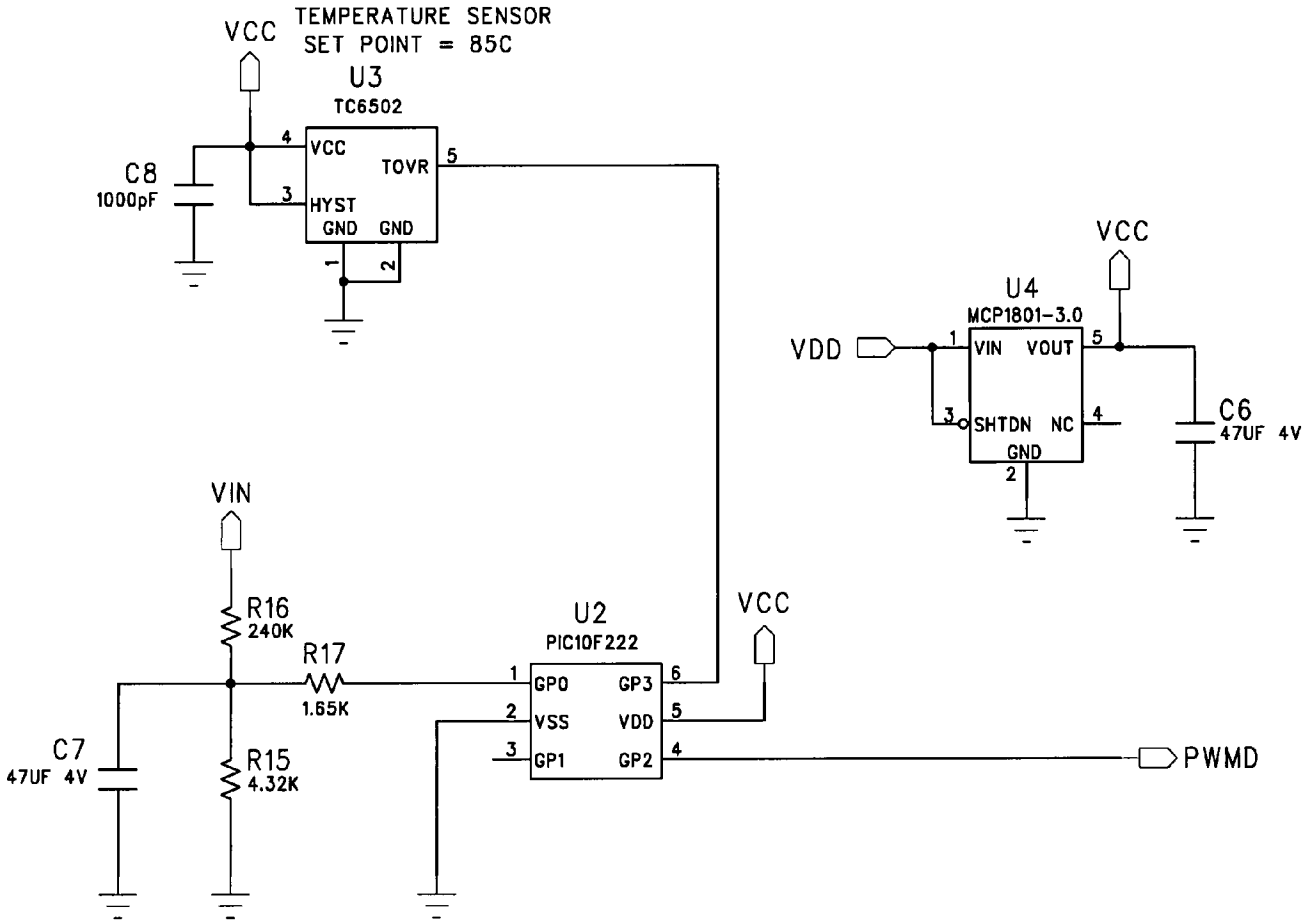
Fig. 11 Dimming Control Circuit For Buckboost-Buck LED Driver

Fig. 12 90-260Vac Dimmable MR16 LED Lamp
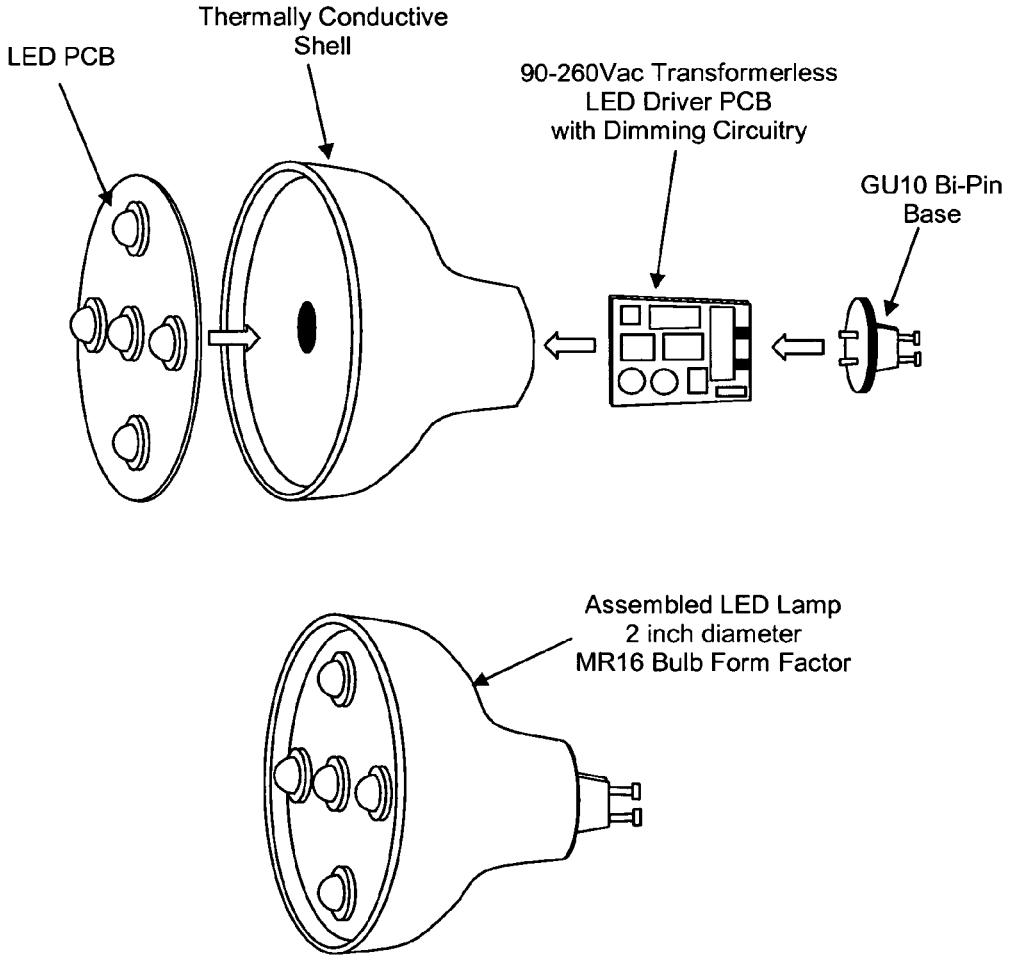

90-260VAC DIMMABLE MR16 LED LAMP

INCORPORATION BY REFERENCE AND OTHER REFERENCES

Applicant incorporates by reference the following: U.S. patent application Ser. No. 12/385,613, Modified Dimming LED Driver, filed Apr. 14, 2009, McKinney et al.; U.S. patent application Ser. No. 12/585,596, Adaptive Dimmable LED Lamp, filed Sep. 18, 2009, McKinney, Steven; and U.S. Pat. No. 7,088,059, dated August 2006, McKinney et al. Other references cited herein include Introduction to Power Supplies, National Semiconductor Application Note AN-556, September 2002; "Understanding Buck Regulators", Super Nade, Overclockers.com—Nov. 25, 2006; Nov. 25, 2006, HV9931 Unity Power Factor LED Lamp Driver Data Sheet, HV9931DB5 Universal Input, Single High Brightness, LED Driver, HV9931 Unity Power Factor LED Lamp Driver Application Note AN-H52.

FIELD OF THE INVENTION

This invention relates to illumination devices such as LEDs (light emitting diodes). The use of LEDs in illumination systems is well known. These devices are especially useful for lighting components, systems, and finished goods. LED lighting is a fast growing segment of the lighting industry due to the efficiency, reliability and longevity of LEDs. Product usage applications include but are not limited to interior and exterior signage, cove lighting, architectural lighting, display case lighting, under water lighting, marine lighting, informational lighting, task lighting, accent lighting, ambient lighting and many others. Special adaptations included in the present invention make the product especially suitable for retrofitting into existing lighting fixtures designed for high voltage MR16 size halogen bulbs.

BACKGROUND OF THE INVENTION

Development of high-brightness LEDs, and their incorporation into Lamps designed to replace incandescent bulbs has revolutionized the lighting industry in recent years. One of the advantages of an LED lamp over an incandescent lamp is its greater efficiency in converting electric energy into light. A typical incandescent bulb produces about 14-17.5 lumens per watt, and most halogen lamps produce about 16-21 lumens per watt. In comparison, LEDs achieving 80-100 lumens per watt are now common. Even when considering the power that is lost in the driving circuitry of an LED lamp which may be 60-80% efficient, LED lamps that are three to six times as efficient as incandescent and halogen bulbs are easily achievable. Thus an LED lamp designed to replace a halogen bulb in a line-voltage fixture would draw much less power from the AC mains than the halogen bulb for which the light fixture was designed. In installations employing many such light fixtures, a great savings in electric energy can be realized by replacing the halogen bulbs with a comparable LED Lamp.

LEDs are current-controlled devices in the sense that the intensity of the light emitted from an LED is related to the amount of current driven through the LED. FIG. 1 shows a typical relationship of relative luminosity to forward current in an LED. The longevity or useful life of LEDs is specified in terms of acceptable long-term light output degradation. Light output degradation of LEDs is primarily a function of current density over the elapsed on-time period. LEDs driven at higher levels of forward current will degrade faster, and therefore have a shorter useful life, than the same LEDs driven at lower levels of forward current. It therefore is advantageous in LED lighting systems to carefully and reliably control the amount of current through the LEDs in order to achieve the desired illumination intensity while also maximizing the life of the LEDs.

LED driving circuits, and any circuit which is designed to regulate the power delivered to a load can generally be categorized as either linear or active. Both types of circuits limit either the voltage, or current (or both) delivered to the load, and regulate it over a range of changing input conditions. For example, in an automotive environment the voltage available to an LED driving circuit can range from 9V to 15 Vdc. A regulator circuit is employed to keep the current delivered to the LEDs at a relatively constant rate over this wide input range so that the LED output intensity does not noticeably vary with every fluctuation in the system voltage.

Linear regulators are one type of device or circuit commonly employed to accomplish this task. A linear regulator keeps its output in regulation only as long as the input voltage is greater than the required output voltage plus a required overhead (dropout voltage). Once the input to the regulator drops below this voltage, the regulator drops out of regulation and its output lowers in response to a lowering input. In a linear regulation circuit, the input current drawn by the circuit is the same as the output current supplied to the load (plus a negligible amount of current consumed in the regulator itself). As the input voltage presented to the linear regulator rises, the excess power delivered to the system is dissipated as heat in the regulator. When the input voltage is above the dropout threshold, the power dissipated in the regulator is directly proportional to the input voltage. For this reason, linear regulators are not very efficient circuits when the input voltage is much larger than the required output voltage. However, when this input to output difference is not too great, linear regulators can be sufficient, and are commonly used due to their simplicity, small size and low cost. Because linear regulators drop out of regulation when the input is below a certain operating threshold, they can also be employed in LED driving circuits to effect a crude dimming function in response to an input voltage which is intentionally lowered with the desire to reduce the LED intensity. The dimming is "crude" in that it is not a linear response for two reasons. First, in the upper ranges of the input voltage above the dropout threshold, the regulator will hold the output in regulation and the LEDs will not dim at all. Once the dropout threshold is reached, the output voltage will drop fairly linearly with a further drop in input. However, LEDs are not linear devices and small changes in voltage result in large changes in current which correspondingly effect large changes in output intensity. As the voltage applied to an LED is lowered below a certain threshold, no current will flow through the LED and no light will be produced. FIG. 2 is an example of a linear regulator circuit configured to drive an LED load. FIGS. 3 and 4 give an example of the response of this linear regulated LED circuit to a dimmed input voltage.

The lower power efficiency of linear regulators makes them a poor choice in large power systems and in systems where the input voltage is much larger than the required LED driving voltage, such as when a 120 Vac or 240 Vac line voltage is used to drive a small number of LEDs. As such, these systems can not practically employ them. As LEDs have increased in power and luminous output, it has become common to employ driving circuits that are active, meaning the power delivered to the end system is dynamically adapted to the requirements of the load, and over changing input conditions. This results in increased system efficiency and less heat dissipated by the driving circuitry. Such active driving circuits are commonly implemented using switching regulators configured as buck, boost, or buck-boost regulators with outputs that are set to constant-voltage, or constant-current depending on the circuit. Typically, in LED driving applications, the switching regulator circuit is adapted to sense the current through the LEDs, and dynamically adjust the output so as to achieve and maintain a constant current through the LEDs. FIG. 6 depicts a typical buck regulator circuit configured to drive an LED load at a constant current.

Many switching regulator devices have been specifically designed for driving high powered LEDs. Manufacturers have built into these devices, inputs which can be pulsed with a PWM (pulse width modulation) or PFM (pulse frequency modulation) control signal or other digital pulsing methods in order to effect a lowering of the output of the switching regulator specifically designed to dim the LEDs. Some devices also have analog inputs which lower the output to the LEDs in response to an input which is lowered over an analog range. With such dimming capabilities built into the switching regulators, very accurate linear dimming of the LEDs can be achieved. Such dimming can be controlled via a network, or some user interface which generates input signals that are converted to the required digital pulses or analog signals that are sent to the switching regulator driver. This method of dimming in LED lighting systems is common. However, it requires control circuitry and user interface equipment which adds a level of cost and complexity to the lighting system.

In many cases, lighting systems and wiring are already installed, and it is desired to replace these lights with LED lights. Or, it is desired to add LED lights to an existing system and have them work in harmony with lights and equipment which are not LED based. There are common household wall dimmers which are employed to dim incandescent lights, and there are high-end theatrical dimming systems which are used to dim entire lighting installations. These types of dimmers only affect the input voltage delivered to the Lights. There is no additional control signal which is sent to them. Therefore, LED lights which are designed to work in these systems must dim in response to a change in the input voltage.

As noted above, linear regulator based LED drivers will dim in response to a lowering of the input voltage. However the dimming is very non-linear and these regulators are not practical for use in line-voltage applications driving a small LED Lamp. Switching regulator drivers will also fall out of regulation and dim their output when the input voltage drops below a certain threshold, but as with linear regulators, when the input is above a threshold, their outputs will be held in regulation and the LED intensity will remain unchanged. This is an especially impractical method of dimming when there is a large difference between the nominal (undimmed) input voltage and the regulating threshold such as the line-voltage LED Lamp situation.

Another problem with dimming switching regulator drivers by lowering their input voltage below the regulating threshold is that these circuits need a certain start-up voltage to operate. Below this minimum voltage, the switching regulator either shuts off completely, or provides sporadic pulses to the LEDs as it attempts to start-up, or passes some leakage current to the LEDs which causes them to glow slightly and never dim to zero. In LED circuits employing multiple lights, each driver circuit can have slightly different thresholds, resulting in differing responses at low dimming ranges. As a result, some lights may flicker, some may be off and some may glow below the threshold voltage. This is unacceptable in most lighting systems that are required to dim using standard ac dimming controllers.

The Modified Dimming LED Driver patent application referenced above detailed an LED driver based on efficient switching regulators which provides smooth and linear dimming from 100% to off, in response to the dimming input voltage that is provided with industry standard ac dimmers.

The Adaptive Dimmable LED Lamp patent application, also referenced above, identified and resolved several unique difficulties arising when an LED Lamp is driven from an electronic transformer such as commonly found in track lighting and other low-voltage lighting fixtures. In these lighting fixtures, the low-voltage transformer interfaces with 120 Vac, 230 Vac, or 240 Vac line voltages, providing a lower (typically 12 Vac) voltage to the Lamp.

There are also installed lighting fixtures for small incandescent or halogen bulbs that do not employ a low-voltage transformer, but instead present the line-voltage directly to the bulb. An LED replacement bulb designed to retrofit into these fixtures requires an off-line power driver capable of regulated DC output current, low DC output voltage and near unity input power factor.

A flyback converter is one common way to achieve the high step-down conversion ratio required for operating low-voltage LEDs from a high input voltage. When operating in discontinuous conduction mode, a flyback converter inherently provides a good power factor since the peak current in its inductor is proportional to the instantaneous input voltage. However, a very large electrolytic smoothing capacitor is needed at the load in order to attenuate the rectified AC line ripple component of the output current. The low dynamic resistance of LEDs aggravates this problem even further. AC line ripple is undesirable in illumination applications due to some people's sensitivity to this frequency of flicker.

There are two problems with electrolytic capacitors in driver circuits for LED replacement bulbs. First, electrolytic capacitors have relatively short life cycles compared to the LEDs and other components in the circuit, and this life cycle is greatly affected by the ambient temperature surrounding the capacitor. Unlike incandescent bulbs which radiate much of the heat generated, an LED lamp must remove excess heat through conduction to the shell and then convection to the air (along with conduction to the fixture). Thus, there are high temperatures in the base of an LED Lamp, which is detrimental to the life of any electrolytic capacitors used in the driver circuitry.

The second problem with electrolytic capacitors is their physical size. These large components quickly consume the small space available in a bulb base, and in many cases (such as in small MR16 bulb bases) this prohibits their use altogether.

There are power conversion topologies that can resolve this problem by cascading converter stages using a single active switch. Most of these topologies include an input boost converter stage for shaping the input current. Hence they require a power transformer with a high step-down turn ratio in order to drive low voltage LEDs, even when galvanic isolation of the output in not required. Such a power transformer is also a large bulky device which is prohibited in the small space available in the base of an LED Lamp.

Because of the reasons discussed above, there is need in the industry for an LED lamp employing driving circuitry that can step down the high voltages of AC mains (90-260 Vac), where the driving circuit can be sufficiently miniaturized to fit into the base of a standard size bulb. There is also need for such an LED lamp to dim from full output to off when connected to typical AC dimmers, in a manner similar to halogen bulbs, such that the LED Lamp can be retrofitted into previously installed lighting fixtures. It is an object of the present invention to provide a complete LED lamp with integral dimmable driving circuitry such as that disclosed in the Modified Dimming LED Driver application referenced above, and which may be powered directly from standard line-voltage of 90 Vac-260 Vac. It is a further object of the present invention to incorporate such LED driving circuitry without the use of electrolytic capacitors or power transformers, so as to fit within the available size of standard bulb bases. It is a further object of the present invention to provide the Lamp in an industry standard MR16 size with a bi-pin GU10 base so as to be a replacement for halogen bulbs common in the lighting industry.

BRIEF DESCRIPTION OF THE DRAWINGS

FIG. 1 is a graph showing a typical relationship of relative luminosity to forward current in an LED.

FIG. 2 is a diagram of a linear regulator circuit as an LED driver.

FIG. 3 is a graph showing the relationship of the luminous intensity of the LEDs vs. the input voltage in a linear regulated LED circuit.

FIG. 4 is a graph of the dimming response in a linear regulated LED circuit.

FIG. 5 is a simplified schematic of a transformerless power converter buckboost-buck topology from Supertex, Inc.

FIG. 6 is an illustration of the buckboost-buck topology when energizing L1 and L2.

FIG. 7 is an illustration of the buckboost-buck topology when de-energizing L1 and L2.

FIG. 8 is an illustration of the buckboost-buck topology during the dead time of L1.

FIG. 9 is a graph of the current/voltage waveforms for the buckboost-buck topology power converter.

FIG. 10 is a detailed schematic of the buckboost-buck LED Driver implemented with the HV9931 PWM controller.

FIG. 11 is a schematic of the dimming control circuit for the buckboost-buck LED driver of FIG. 10.

FIG. 12 is an exploded view and assembled view of one embodiment of the invention.

SUMMARY OF THE INVENTION

The present invention is directed to an integral LED Lamp adapted to fit industry standard high-voltage MR16 sized fixtures with GU10 connectors in place of halogen bulbs, and which may be driven directly from the high-voltage (90-260 Vac) existing in such fixtures. An advantage of the present invention is that it is dimmable when coupled with existing dimming circuits, dimming from full illumination to off. A further advantage of the present invention is that it eliminates the use of electrolytic capacitors commonly required in switcher-regulator circuits, thereby maximizing the life of the Lamp driver circuitry especially considering the high ambient temperatures typically encountered in the base of a bulb. Further advantages of the invention will become apparent to those of ordinary skill in the art through the disclosure herein.

DETAILED DESCRIPTION OF THE INVENTION

FIG. 5 is a simplified schematic diagram of Supertex Inc's proprietary single-stage, single-switch, non-isolated topology, cascading an input power factor correction (PFC) buck-boost stage and an output buck converter power stage. This transformerless power converter topology offers numerous advantages useful for driving high-brightness LEDs, including unity power factor, low harmonic distortion of the input AC line current, and low output current ripple. The output load is decoupled from the input voltage with a capacitor making the driver inherently failure-safe for the output load. This power converter topology also permits reducing the size of the filter capacitor needed, enabling use of non-electrolytic capacitors.

Referring to FIG. 5, the input buck-boost stage consisting of L1, C1, D1 and D4 is cascaded with an output buck stage including L2, D2, D3 and Co. Both converter stages share a single power MOSFET M1. The input buck-boost stage operates in discontinuous conduction mode (DCM), while the output buck stage runs in continuous conduction mode (CCM). Both converter stages can operate as step-down voltage converters. The overall step-down ratio is a product of the step-down ratios of the two converter stages. Thus a high step-down ratio is achieved without using a transformer.

While a detailed explanation of the operation of this converter topology can be found in the references cited above, a basic understanding of the circuit operation can be understood from a study of FIGS. 6 through 8. In these figures, the current paths are shown by the heavy gray freeform arrows, and the circuit components which are conducting current are shown in black. The circuit components which are not conducting current are illustrated in light gray.

FIG. 6 shows the operating state of the converter when L1 and L2 are charging. Switching the MOSFET M1 "on" applies the rectified AC line voltage across L1, which causes the current in L1 to rise linearly. At the same time, the bulk capacitor C1 powers the output buck stage, (C1 voltage polarity is negative with respect to ground when M1 is on). The current in L2 ramps up. Now referring to FIG. 7, when M1 is turned off, D1 becomes forward-biased. The input inductor current diverts into C1, recharging this capacitor. At the same time, the current in the output inductor L2 routes through D3. The current in L1 ramps down. As soon as the current reaches zero, the diode D1 becomes reverse-biased and prevents the current in L1 from reversing. (The reverse current flow back into the input source would otherwise cause harmonic distortion of the input current and reduction in the overall efficiency.) FIG. 8 depicts this switching state.

The value of the bulk capacitor C1 needs to be large enough to attenuate rectified AC line ripple. Then the duty cycle D and the switching frequency $F_S$ can be assumed constant over the AC line cycle. In this case, both the peak current $I_{L1(PK)}$ in L1 and the average input current $I_{IN}$ are directly proportional to the input voltage $V_{IN}$. Refer to FIG. 9 for an illustration of these current/voltage relationships. Using the current/voltage equation for an inductor, it can be seen that $I_{L1(PK)}=(T_{ON}\cdot V_{IN})/L1$, where $T_{ON}=D\cdot T_S=D/F_S$. Therefore, $I_{L1(PK)}=(D\cdot VIN)/(L1\cdot F_S)$. The average input current can be shown to be $\frac{1}{2}\cdot D\cdot I_{L1(PK)}=V_{IN}\cdot D^2/(2L1\cdot F_S)=V_{IN}/R_{eff}$. The factor $R_{eff}=(2L1\cdot F_S)/D^2$ is the effective input resistance of the converter. This feature of the switching converter of FIG. 5 ensures low harmonic distortion of the input AC current and near-unity power factor.

Supertex, Inc has developed a peak current-mode PWM controller, the HV9931, optimized to drive this buckboost-buck topology converter. This controller features two identical current sense comparators for detecting negative current signal levels. One of the comparators regulates the output LED current, while the other is used for sensing the input inductor current. The second comparator is mainly responsible for the converter start-up. The control scheme inherently features low inrush current and input under-voltage protection. The HV9931 can operate with programmable constant frequency or constant off-time. The constant off-time operating mode improves line regulation of the output current, reduces voltage stress of the power components and simplifies regulatory EMI compliance. The HV9931 can be powered directly from its VIN pin, and takes a voltage from 8V to 450V. When a voltage is applied at the VIN pin, the HV9931 seeks to maintain a constant 7.5V at the VDD pin. The VDD voltage can be also used as a reference for the current sense comparators. The regulator is equipped with an under-voltage protection circuit which shuts off the HV9931 when the voltage at the VDD pin falls below 6.2V.

FIG. 10 shows a detailed schematic of one implementation of the LED driver circuit using the HV9931 in a buckboost-buck regulator topology. This schematic is based on the HV9931DB5 demo board from Supertex cited above. The HV9931, U1 in FIG. 10 has a 178KΩ resistor R12 connected between RT and GATE. As detailed in the HV9931 data sheet, this sets a constant off-time for the HV9931 oscillator equal to:

$$T_{OFF}[\text{us}]=(R12[\text{K}\Omega]+22)/25=8\text{us}.$$

The output LED current is programmed via resistors R13, R10, and R11 to approximately 350 mA as follows. According to the HV9931 data sheet, the output current is programmed based on the formula:

$$R_{CS2}=((I_O\tfrac{1}{2}\Delta I_{L2})/7.5\text{V})\cdot R_{REF2}\cdot R_{S2}$$

where RCS2 is the current-sense feedback resistor (which in this circuit implementation is the sum of R10 and R13), $I_O$ is the average output current delivered to the LEDs, $\tfrac{1}{2}\Delta I_{L2}$ is half the peak-to-peak ripple current in the output inductor L2, $R_{REF2}$ is the reference resistor from VDD to CS2 of U1 (R11 in FIG. 10), and $R_{S2}$ is the current-sense resistor (R4). The output inductor L2 has been selected (based on the HV9931DB5 design) to keep the peak-to-peak ripple current at approximately 30%. Therefore, the LED current equation for the circuit of FIG. 10 can be calculated as:

$$(R10+R13)=((I_{LED}+0.15\cdot I_{LED})/7.5\text{V})\cdot R11\cdot R4$$

Solving for $I_{LED}$ and substituting the component values from FIG. 10 gives:

$$I_{LED}=7.5\text{V}\cdot(R10+R13)/1.15\cdot(R11\cdot R4)=7.5\cdot(931+100)/1.15\cdot(19.1\text{K}\cdot 1)=352\text{ mA}$$

As explained in the HV9931DB5 document cited above, the circuit is designed to regulate the output current at 350 mA. However, when the output current is measured with an AC waveform, the measured current is typically around 300 mA. This drop in the current is due to the demo board turning off when the instantaneous input voltage is less than about 40V (minimum operating $V_{IN}$=8V, plus Zener diode D4=33V). This dropout at low voltages causes the average current to drop by about 50 mA. The output current can be increased or decreased by increasing or decreasing the value of resistor R10 proportionally.

The values of all the capacitors in the LED driver circuit of FIG. 10 are small enough that they can be implemented with ceramic capacitors. As discussed in the Background section above, this not only minimizes the size of the circuit, allowing it to fit into the small space available in the bulb base, but it also improves the reliability and life of the circuit.

It should be noted that the addition of the Zener diode D7 is an improvement over the HV9931DB5 circuit, limiting the output voltage to 51V. This provides open circuit protection in the case of a disconnected LED load (or failure of one of the LEDs causing an open-circuit). As noted in the HV9931DB5 document, the original demo board circuit from Supertex does not protect against open LED conditions which would damage the circuit.

FIG. 11 details several other additions to the HV9931DB5 demo circuit as implemented in this embodiment of the invention. The microcontroller U2, together with the temperature sensor U3, and the voltage regulator U4 provide a dimming circuit which produces a PWM signal to the PWMD input of the HV9931 U1 of FIG. 10. The resistor divider of R15 and R16, together with the filter capacitor C7, provides a sample of the input voltage VIN to the analog input GP0 of the microcontroller U2. The microcontroller U2 then outputs the PWMD signal with a duty cycle proportional to the relative value of VIN, according to a preprogrammed dimming algorithm. The HV9931 U1 of FIG. 10 disables its GATE driver and turns off the MOSFET Q1 whenever PWMD is logic low. The average output current sent to the LEDs is then proportional to the duty cycle of the PWMD signal. The temperature sensor U3 in FIG. 11 provides an over-temperature signal to the microcontroller U1. The microcontroller reduces the PWMD duty cycle and thus lowers the LED output current in response to an over temperature condition, allowing the LED Lamp to continue to illuminate, but at a reduced level until the temperature drops below the trip point.

The dimming function of the driver circuit in response to a lowered input voltage allows the LED Lamp to dim its output illumination when connected to standard dimming circuits. The dimming algorithm programmed into the microcontroller can be set up to provide a linear dimming curve, or to mimic the dimming response of a halogen bulb, or to provide many other effects. This dimming method was first disclosed in the Modified Dimming LED Driver patent application, and further discussed in the Adaptive Dimmable LED Lamp patent application, both cited above.

In order to provide similar dimming for 120 Vac circuits or 240 Vac (or 230 Vac) circuits, the dimming program can be scaled based on the targeted fixture voltage. Or, as an alternative, the resistor divider of R15 and R16 can be modified for various voltages. For example, the component values shown in FIG. 11 (R15=4.32KΩ, R16=240KΩ) have been set for a 240 Vac version of the LED Lamp. For a 120 Vac version, R16 can be changed to 120KΩ, so that the microcontroller in both versions receives the same sampled input levels on its GP0 input. Then the same dimming program could be used in both versions.

Depending on the values of the voltage divider and filter components (R15, R16, and C7 of FIG. 11), there will be some amount of 60 Hz ripple on the voltage presented to GP0 of U5. The microcontroller can be programmed to take a number of samples of this voltage and then average the result in order to further filter the sampled input level so that no 60 Hz ripple is passed on to the LEDs. The microcontroller program may also execute a root-mean-squared (RMS) calculation on the input samples in order to get a more accurate reading of the input voltage level.

This method for dimming LEDs driven from a constant-current switcher-regulator circuit was first disclosed in the Modified Dimming LED Driver patent application and in the Adaptive Dimmable LED Lamp patent application, both referenced above. It has been incorporated into the present invention using the buckboost-buck regulator driver disclosed above, as the method of driving a series connected string of 5 LEDs from a 90-260 Vac input. In the present invention, this driving circuitry is implemented on a small Printed Circuit Board incorporated into the base of a thermally conductive shell which has been sized to fit a common bulb size referred to as an MR16. The MR designation in the lighting industry stands for "metal reflector", referring to the typical parabolic metal reflector shape used to focus the light emitted from the bulbs in a forward direction. The parabolic reflector is not needed with LED technology, as the LEDs are by nature directional light emitters. The "16" in the MR16 bulb designation refers to the diameter of the bulb in eighths of an inch (16 eighths=2.0" diameter). MR16 is a common size bulb in the lighting industry, used in many track lighting and recessed can fixtures. MR16 bulbs designed for low voltage fixtures have a bi-pin base with straight pins 5.3 mm apart. High voltage MR16 bulbs have a twist-lock bi-pin base, with 10 mm separation between pins, designated as GU10. The present embodiment of the invention incorporates this standard GU10 base for retrofitting into industry standard lighting fixtures. FIG. 12 shows the major components of this embodiment of the present invention.

What is claimed is:

1. An LED lamp comprising:

One or more high-power LEDs, and a switcher regulator LED driver circuit, said LED driver circuit receiving standard input voltage of nominal 90-260 Vac range from industry standard lighting fixtures, sampling said input voltage, and producing regulated current to said LEDs in proportion to the relative value of said input voltage; and a thermally conductive shell forming a mounting surface for said LEDs, said shell containing a cavity housing said LED driver circuit, and providing a thermally conductive path to transfer heat from said LEDs and said driver circuit through said shell and into surrounding air; and a base enclosing said cavity of said shell, and receiving said input voltage from said lighting fixtures through conductive terminals in said base, and passing said input voltage to said LED driver circuit.

2. The LED lamp of claim 1 wherein said shell conforms to the lighting industry standard MR16 bulb size, and said base conforms to the lighting industry standard GU10 bi-pin size.

3. The LED lamp of claim 2 wherein said LED driver circuit is a single-switch, power factor corrected, cascaded power converter, said power converter comprising:

an input buck-boost stage operating in discontinuous conduction mode (DCM), and an output buck stage operating in continuous conduction mode (CCM); and achieving a high step-down ratio sufficient to drive said low-voltage LEDs from said line voltage, without the need for a power transformer, and without the need for electrolytic capacitors.

4. The LED Lamp of claim 3 wherein said power converter achieves near-unity power factor.

5. The LED Lamp of claim 2 wherein said LEDs comprises five high brightness (HB) 1-Watt LEDs.

6. The LED Lamp of claim 3 wherein, said LED Driver circuit additionally contains a microcontroller, said microcontroller programmed to:

sample voltage level of said input voltage, and compare said sample to a preset range, and cause regulated current to said LEDs to be adjusted according to a programmed formula in proportion to the relative value of said input voltage as compared to said preset range.

7. The LED Lamp of claim 6 wherein said programmed formula produces a linear progression from zero to maximum as said sampled voltage level ranges from a preset minimum value to a preset maximum value.

8. The LED Lamp of claim 6 wherein said programmed formula produces a progression of regulated current to said LEDs over said range such that the illumination output curve of said LEDs mimics the intensity change response of a separate illumination source subject to the same input voltage.

9. The LED Lamp of claim 8 wherein said separate illumination source is a halogen bulb.

10. The LED Lamp of claim 7 wherein said preset minimum value is defined as a positive voltage sufficient for said microcontroller to remain operational, causing a deterministic shut-down of said LED driver.

11. The LED Lamp of claim 10 wherein said programmed formula produces a linear progression from zero to maximum as said sampled voltage level ranges from a preset minimum value to said adjusted maximum value.

12. The LED Lamp of claim 11 wherein said preset minimum value is defined as a positive voltage sufficient for said microcontroller to remain operational, causing a deterministic shut-down of said LED driver.

13. The LED Lamp of claim 10 wherein said programmed formula produces a progression of regulated current to said LEDs over said range such that the illumination output curve of said LEDs mimics the intensity change response of a separate illumination source subject to the same input voltage.

14. The LED Lamp of claim 13 wherein said separate illumination source is a halogen bulb.

* * * * *